United States Patent [19]

Domingue

[11] Patent Number: 4,520,352

[45] Date of Patent: May 28, 1985

[54] FIRE ALARM SYSTEM AND METHOD

[75] Inventor: Willard A. Domingue, Houston, Tex.

[73] Assignee: Fire Trumpet of America, Inc., Houston, Tex.

[21] Appl. No.: 506,206

[22] Filed: Jun. 20, 1983

[51] Int. Cl.[3] ..... G08B 17/02

[52] U.S. Cl. ..... 340/590

[58] Field of Search ..... 340/584, 590; 169/59; 337/416, 401, 405

[56] References Cited

U.S. PATENT DOCUMENTS 3,297,846 1/1967 Peltier ..... 340/590

3,500,276 3/1970 Hingorany et al. ..... 337/416

FOREIGN PATENT DOCUMENTS 144699 12/1978 Japan ..... 340/590

*Primary Examiner*—Anthony V. Ciarlante

*Attorney, Agent, or Firm*—Neal J. Mosely

[57] ABSTRACT

A fire alarm system and method utilizes a heat-shrinkable material, such as a sheet of polyethylene plastic film, to break a thin foil conductor attached thereto and thereby activate an alarm.

6 Claims, 7 Drawing Figures

FIRE ALARM SYSTEM AND METHOD

BACKGROUND OF THE INVENTION

The present invention relates to alarm systems, and particularly to heat sensing systems which are designed to give early warning of a fire before it has progressed to a major blaze.

Every year, in cities and communities across the nation, fire catastrophies cause countless losses of life and property. For example, in the United States fire is the largest single cause of injuries in hotels and motels, 36% of such injuries being caused by smoking in bed. Not counted in such statistics in the untold pain and suffering of those injured in residential and commercial fires. Such statistics cannot begin to reflect the terrible anguish born by these and others not only over the loss of their cherished possessions, but even more over the sufferings and losses of their friends and loved ones.

As technology progresses, and as the public more and more accepts the fact that we all share a common risk and exposure to these sudden and unexpected losses, countermeasures have become increasingly evident. For example, building codes in more and more communities are requiring public buildings, nursing homes, hotels, motels, and so forth, to install and maintain smoke detectors and sprinkler systems, to use fire retardant materials, and so on. More and more homeowners are installing smoke detectors in their homes to give early warning of a fire. More expensive residential systems will even transmit an alarm directly to the local authorities when a fire or smoke is detected.

Unfortunately, most such systems are as expensive as they are sophisticated. Their use is therefore restricted to those who can afford them, and even then to only those applications which their users consider to be "cost effective". Additionally, such systems, notwithstanding their sophistication, are often woefully deficient in furnishing the earliest possible warning in certain types of fires. For example, one of the most tragic fires is the mattress fire caused by a smoker who falls asleep while smoking in bed. Such a person can suffer serious body burns (not to speak of the dangers from the smoke and fumes generated by the smoldering mattress fire) long before a conventional smoke or fire detector will respond.

Other examples where inexpensive, versatile detectors would be especially useful include: detecting imminent spontaneous combustion due to unfavorable temperature conditions, as in a closed area; monitoring the condition of goods subject to heat damage during transit and sounding an immediate alarm upon an unfavorable temperature condition, rather than simply activating a tell-tale warning tag which is usually discovered much later after the damage has progressed to far to be corrected; and so forth. Such needs often go unanswered because presently available detectors are simply too expensive for mass use in statistically low-risk situations.

A need thus remains for an inexpensive, uncomplicated, versatile and reliable fire alarm system and method which will give the earliest possible warning of a fire hazard. Preferably such a system and method can be configured to give a warning long before temperatures rise to the point of combustion. In some cases, such as detecting a mattress fire, the warning should be given long before the temperature rises to that of a cigarette, 1300° F. Desirably, such a system and method would lend itself readily to economical use in virtually any environment or application where early and reliable detection of an undesirably high temperature is needed.

The following patents illustrate various prior art concepts having some relevance to this invention:

U.S. Pat. No. 2,488,622 (Girogianni, issued Nov. 22, 1949)

This patent discloses a flash blub or locking meter in parallel with a normally closed circuit to give a positive indication should the circuit ever be broken, even if only intermittently.

U.S. Pat. No. 3,158,713 (Margulies, issued Nov. 24, 1964)

This patent discloses a latching indicator to indicate an open electrical circuit, such as a blown fuse.

U.S. Pat. No. 3,210,751 (Shiraishi, issued Oct. 5, 1965)

This patent discloses a circuit which requires only a small amount of electricity to monitor a closed loop circuit and actuate an alarm if the loop circuit is broken.

U.S. Pat. No. 3,367,175 (Morreal et al., issued Feb. 6, 1968)

This patent discloses an ablation sensor containing embedded wires which form a plurality of electrical switches. The wires then open or close electrical circuits as they erode, melt, or ablate along with the material. Opening of the normally closed circuits thus results, not from fracturing of the conductor caused by thermally induced melting and migration of the adhering substrate material, but by melting and evaporation of the conductor when the adjacent substrate ablates. The "break" in the conductor thus results from erosion, not from physical migration of an underlying substrate.

U.S. Pat. No. 3,426,217 (Womble, Jr., issued Feb. 4, 1969)

This patent discloses a device which conditions a signal so that an exact indication can be given of exactly which wire(s) from a set of four have been broken.

U.S. Pat. No. 3,510,762 (Leslie, issued May 5, 1970)

This patent discloses a temperature monitoring device composed of a high frequency cable having a temperature sensitive dielectric. When the dielectric changes state at a certain location (melts or vaporizes), the impedance of the cable thereat changes, and the location can be detected by standard pulse echo techniques.

U.S. Pat. No. 3,595,228 (Sinon Et al., issued July 27, 1971)

This patent discloses an electric alarm device for detecting a break in a releasable flow linme coupling, such as a respirator.

U.S. Pat. No. 3,813,662 (Lewis, issued May 28, 1974)

This patent discloses an alarm system, which detects both open-circuiting of a loop and effective short-circuiting of the loop rectifier element.

U.S. Pat. No. 3,898,641 (Banner, issued Aug. 5, 1975)

This patent discloses a security rope containing wires coupled to a boat mooring bit such that an alarm is set off when the rope circuit is disturbed.

U.S. Pat. No. 4,288,425 (Cooke, issued Oct. 14, 1980)

This patent discloses a wire-containing alawm glass laminated to a plastic layer of polyvinyl butyral which becomes opaque upon breakage.

U.S. Pat. No. 4,236,146 (Clark et al., issued Nov. 25, 1980)

This patent discloses a switchless circuit for constantly and simultaneously monitoring both open and closed circuits.

U.S. Pat. No. 4,263,589 (Lewiner et al., issued Apr. 21, 1981)

This patent discloses an electromechanical device for detecting a break in a DC circuit.

These prior art references disclose various elements of the prior art having some pertinence to this invention but do not disclose the concept of a fire alarm system and method in which the heat sensor comprises a continuous wire secured to or laminated or sandwiched between one or more sheets or films of heat migratable plastic whereby the application of heat on a localized basis, as in the case of a cigarette dropped on a bed, or on a more generalized basis, as in the case of an entire room or zone being brought to a somewhat elevated temperature, causes the plastic to shrink and break the wire, or allow the wire to separate by melting, to set off the associated alarm.

SUMMARY OF THE INVENTION

Briefly, the present invention meets the above needs and purposes with an inexpensive, versatile, uncomplicated and reliable detection system and method which take advantage of the heat-migration properties of certain plastic materials. In the preferred embodiment, a heat-shrinkable thermoplastic film is used. A thin foil conductor is adhered to the plastic, and when the plastic shrinks it interrupts the continuity of the foil by breaking it, thereby activating a suitable alarm.

More specifically, in the preferred embodiment a flexible sheet of heat-shrinkable polyethylene plastic film material forms the heat-shrinkable substrate. It is well known that heat-shrinkable film materials, widely used for example in the packaging and construction industries, will shrink away very quickly when heated to temperatures (e.g., 240°–300° F.) well below their combustion temperature. Approach a sheet of this material with an open flame, for example, and it will shrink away violently from the flame.

Onto such a sheet there is then applied a conductive wire, either linearly or as a grid, depending upon the application. Preferably the wire is a thin flexible foil conductor, made, for example, of a material such as ordinary electrical solder. Such a material has great tolerance for bending and pressure stresses, such as might be encountered when used under the sheets of a bed. However, since it is made as a thin foil, its tensile strength is quite limited. In fact, the plastic substrate provides the major support for protecting the foil from fracture by tension. Therefore, when the plastic shrinks upon being heated to its melting point, it easily pulls the foil along with it—breaking the foil in the region of the shrinkage.

A conventional continuity monitoring circuit detects this interruption of the continuity of the conductor foil. The prior art shows numerous examples of appropriate and now well-known circuits which can perform this function, with little current drain for long life, and safe for use in bedding, medical equipment, hazardous environments, and so forth. Any such detector circuit may be used, and is desirably connected to an alarm to generate an immediate alarm signal upon detection of breakage of the conductor.

When used in bedding, the foil may be laminated or "sandwiched" between two sheets of the heat-shrinkable sheet material. The conductor is preferably arranged as a grid, with its inter-conductor spacing no greater than about $\frac{3}{8}''$. This spacing is equal to the diameter of a cigarette. Therefore, with the spacing between adjacent elements of the grid being less than the cigarette diameter of substantially $\frac{3}{8}''$, there is good assurance that a lighted cigarette dropped upon the heat-shrinkable plastic substrate will be detected. Further, a low melting point plastic is used, preferably one which melts at an approximate temperature of 250° F., to cause the conductor foil to break and set off the alarm.

It is therefore an object of the present invention to provide an improved fire alarm system and method; a fire alarm system and method having a conductor adhered to a heat-migrating substrate and configured to interrupt the continuity of the conductor as a result of migration of the substrate when it is subjected to sufficient heat to cause such heat-migration; in which the substrate may be made of heat-shrinkable plastic film material; in which the substrate and conductor may be configured in a virtually unlimited number of shapes and patterns to accommodate the widest possible range of applications; which includes circuit continuity monitoring means connected to the conductor to detect breakage thereof; which is especially well adapted to detecting dangerous domestic fire conditions such as a mattress fire; and to accomplish the above objects and purposes in an inexpensive, uncomplicated, highly versatile and reliable method and apparatus suited for the widest possible use for giving the earliest possible warning of a smoke hazard, fire hazard, or other undesirably high temperature condition.

Other objects and advantages of the invention will be apparent from the following description, the accompanying drawings and the appended claims.

DESCRIPTION OF THE PREFERRED EMBODIMENTS

Figure 1:
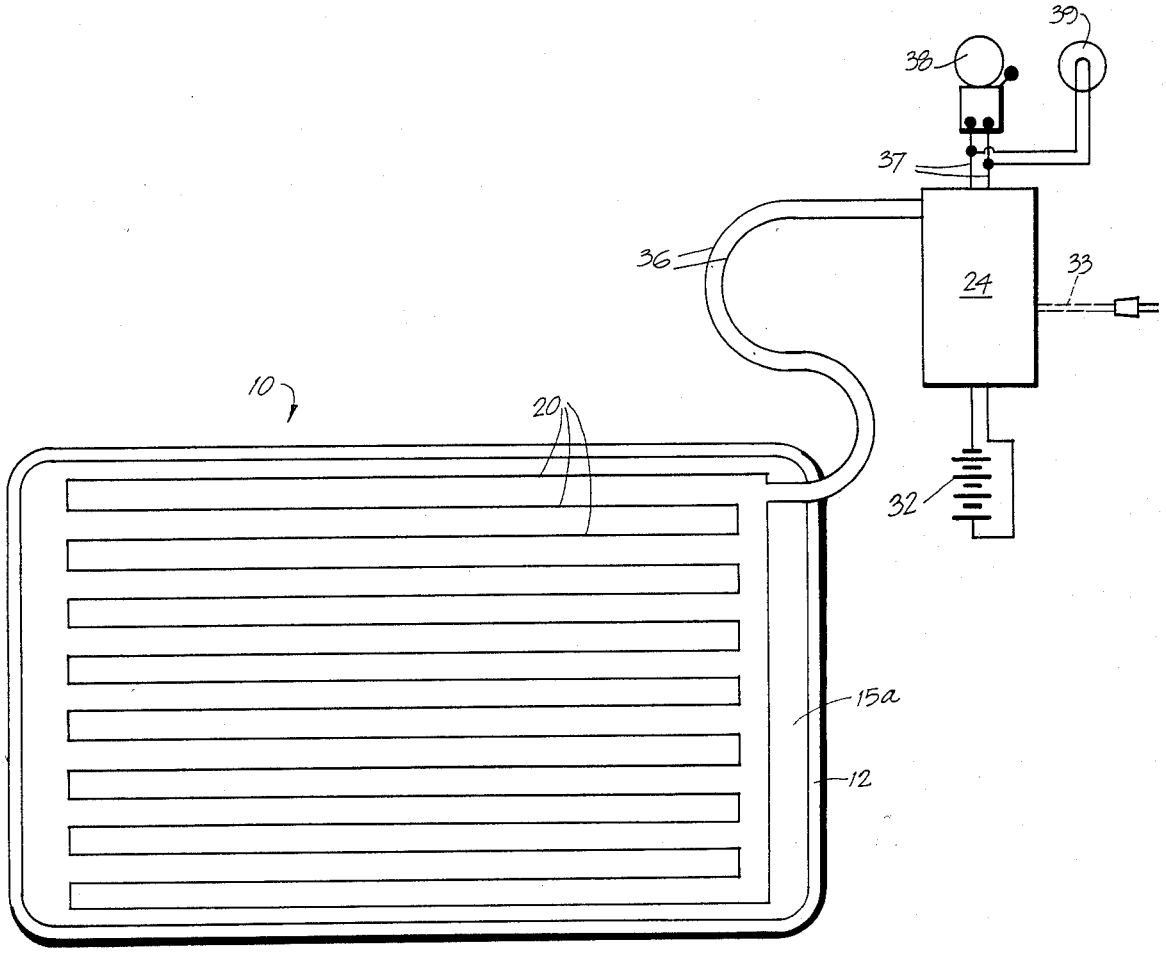
FIG. 1 is a somewhat figurative plan view of a preferred embodiment of the invention adapted for detecting a mattress fire.
Figure 2:
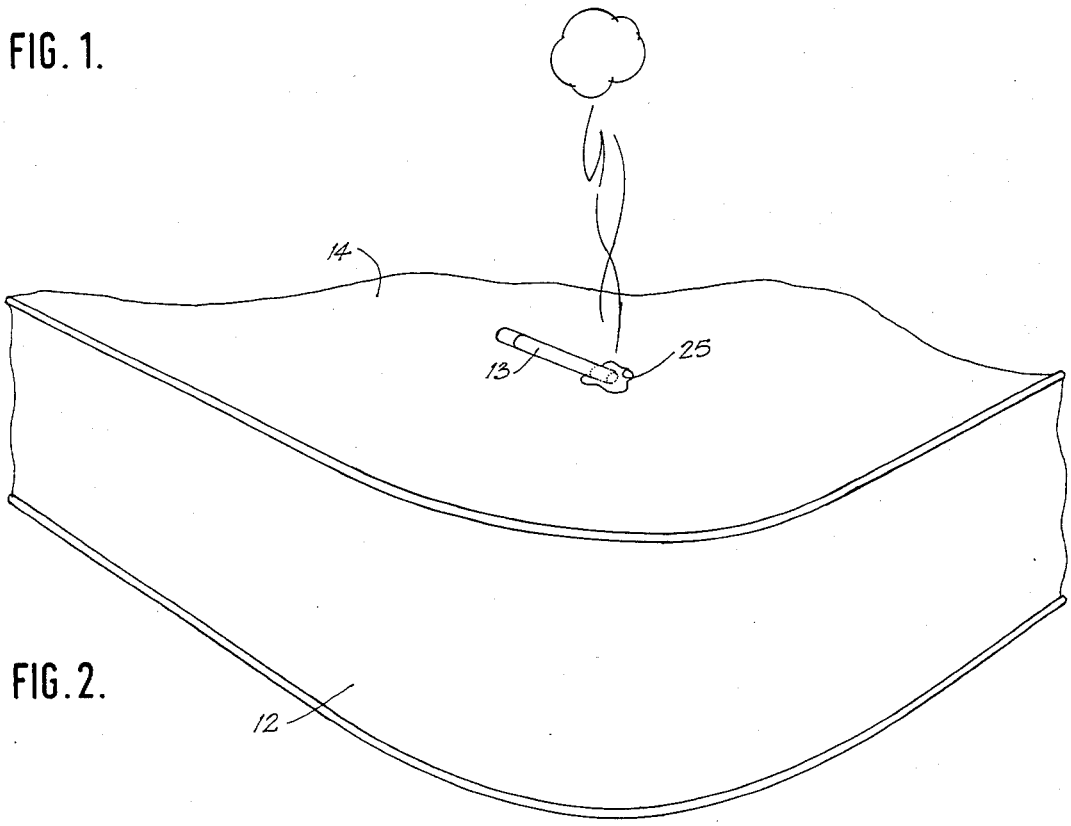
FIG. 2 is a fragmentary perspective view of the FIG. 1 embodiment showing a lighted cigarette thereon and a heat-shrinkable substrate migrating away thererom due to the heat of the cigarette.

With reference to the drawings, the new and improved alarm system for detecting fires and other undesirably elevated temperatures, and the method therefor according to the present invention, will now be described. FIG. 1 shows a somewhat figurative plan view of a preferred embodiment 10 of the invention adapted for detecting a mattress fire, such as might occur on a mattress 12 from a lighted cigarette 13 (FIG. 2).

Figure 5:
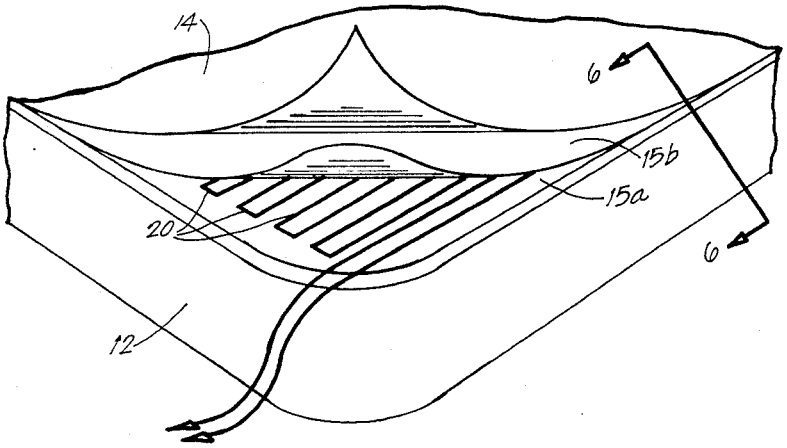
FIG. 5 is a fragmentary perspective view of the embodiments of FIGS. 1 and 2 installed on a bed under the bed sheet, with elements partially separated at one corner to better show the constructional details.
Figure 6:
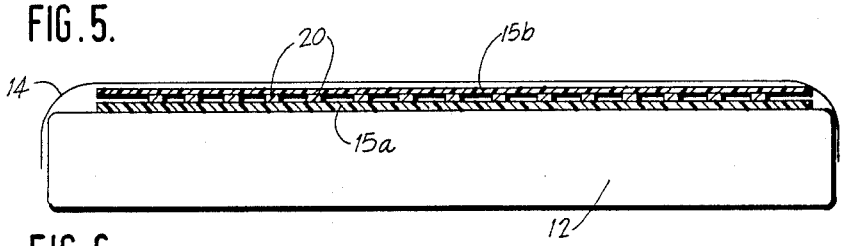
FIG. 6 is a cross-sectional view taken generally on line 6—6 in FIG. 5.

Referring to FIGS. 5 and 6, embodiment 10, which is preferably located between the mattress 12 and the bed sheet 14, includes a first or lower flexible substrate sheet 15*a* and a second or upper substrate sheet 15*b* of a material which migrates upon exposure to heat. The preferred material is a film or sheet of heat-shrinkable plastic material, such as low density polyethylene (LDPE). (The terms "film" and "sheet", although often used in the plastics industry to distinguish materials according to their thicknesses, will be used indescriminately herein since the overall physical properties are more important to the present invention than just the particular thickness of the material.) Such heat shrinkable materials are well known in the chemical industry. See, for example, "Film and Sheeting Materials" in the Kirk-Othmer *Encyclopedia of Chemical Technology,* Third Edition, Volume 10, pp. 216–246 (1980), where heat-shrinkability is described as arising "from an elastic memory imparted to some thermoplastic films during their manufacture by either stretch orientation or by cross-linking induced through irradiation. Shrinkage takes place when heat is applied to the film, and it tends to revert to its original unoriented state." (pp. 217–227). This article lists fourteen heat-shrinkable materials generically (p. 226), and, throughout the article, lists and describes various properties and characteristics of these materials. For a listing of twenty-six suppliers of shrink films, see p. 759 of the Modern Plastics Encyclopedia 1982–1983.

Heat-shrinkable films are available in many thicknesses, flexibilities, and melting points. The particular choice will depend, of course, upon the application at hand. In the preferred embodiment described herein, a low melting point thermoplastic material is preferred. Examples (see Kirk-Othmer, id.) include low density (LDPE) and medium density (MDPE) polyethylene (having melting points of about 250° F.), oriented polystyrene (having a melting point of about 250° F.), poly(-vinylidene chloride) (PVDC) (having a melting point of about 250° F.), methyl acrylate ethylene copolymer (having a melting point of about 140° F.), and vinyl acetate ethylene copolymer (having a melting point of about 150° F.).

In the preferred embodiment 10, a thin (e.g., 0.030" thick), very flexible (i.e., not brittle) polyethylene film 15 with a low melting point is recommended. The melting point is preferably 250° F. or less to provide an alarm response before temperatures are reached at which a cigarette burns (e.g., 1300° F.).

Sandwiched or laminated between sheets 15*a* and 15*b* is a conductor 20. In the preferred embodiment, conductor 20 is a single, continuous conductor arranged in a zig-zag foil grid configuration, as shown in FIG. 1. Conductor 20 is preferably made of a very soft, flexible material such as 20 S.W. 6 alloy SN60 solder film, 0.002"–0.004" thick, which is printed onto one of the sheets 15. Such a conductor has mechanical properties which desirably withstand flexing and pressure when used on a bed mattress, but which readily breaks when the adjacent sheet 15 migrates upon application of sufficient heat thereto. The SN60 alloy also has the high conductivity/low resistance desired for best results when used with an electrical continuity monitoring circuit such as circuit 24. Other foils, such as typically seen on bank windows as part of intrusion alarm systems, are for the most part too brittle for applications involving flexing, but could well be considered for static monitoring applications.

With reference to FIG. 2, a lighted cigarette 13 is shown lying upon sheets 15. Due to the heat from the burning cigarette, the adjacent heat-shrinkable material has reached its melting point and, due to its heat-shrink properties, has vigorously pulled away from the cigarette's flame, leaving a hole 25.

Figure 3:
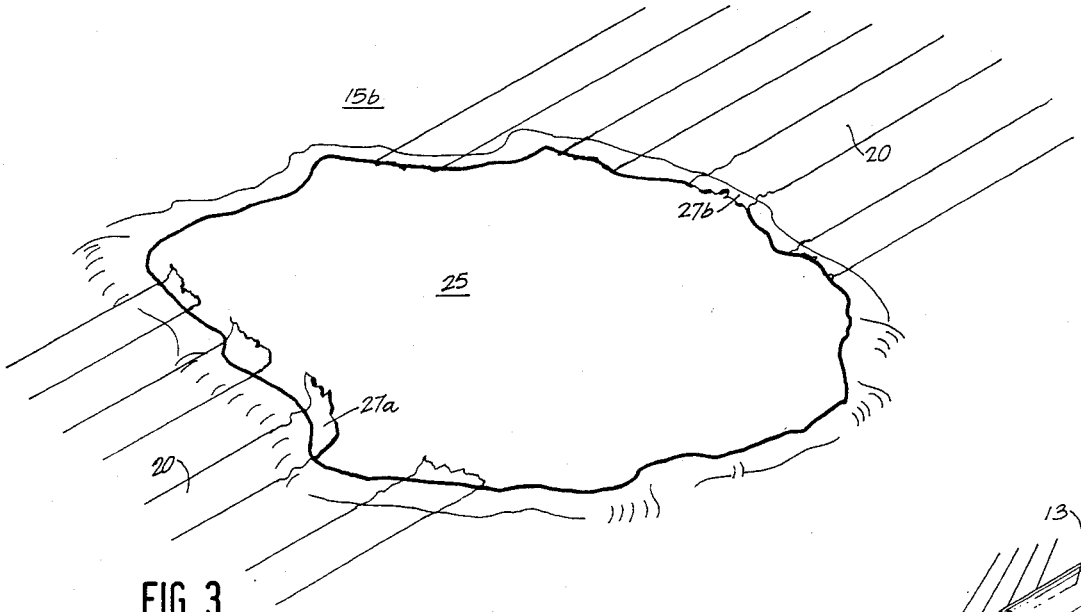
FIG. 3 is an enlarged fragmentary view of the hole in the substrate as shown in FIG. 2, the broken conductor also being shown therein.

FIG. 3 shows the resulting hole 25 in greater detail. As may be seen therein, the plastic, as it withdrew from the heat, tore the conductor 20 in this region since the conductor was adhered to the plastic. This has caused an interruption in the continuity of conductor 20, represented by the broken ends 27*a* and 27*b* thereof.

Figure 4:
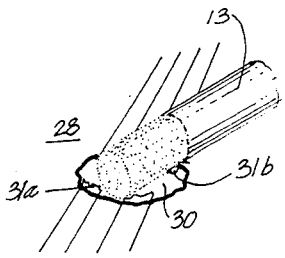
FIG. 4 is a view similar to FIG. 3 of a heat-migrating substrate made of non-heat-shrink material, responding to a lighted cigarette.

FIG. 4 illustrates interruption of the continuity of conductor 20 when a heatmigrating material 28 is used which is not a heat-shrinking material. Such materials 28 would include many thermoplastics which are not heat-shrinkable materials (such as described above) since such plastics still tend to melt and withdraw, or form holes, when exposed to sufficient heat. Such a hole 30 is illustrated. As may be seen therein, the continuity of conductor 20 has been interrupted, leaving broken conductor ends 31*a* and 31*b*.

Circuit 24 may be any of the numerous monitoring circuits well known for security/safety systems which monitor circuits for a break in continuity. When used with bedding, safety reasons recommend that circuit 24 should be of the low voltage type isolated from line current. (U.S. Pat. No. 3,595,228, issued July 27, 1971 to Simon et al., presents one example of this type of circuit.) As shown, a battery 32 provides power, assuring an alarm regardless of whether household AC current is available. Conventional testing and warning circuitry would also desirably be included to provide for testing the condition of the battery, and warning of a weak battery condition (such as by emitting an intermittent beep). An optional AC power line 33 is also shown.

The electrical monitoring circuit 24 is connected to conductor 20 by leads 36. Leads 37 connect circuit 24 to a suitable alarm device, such as a bell 38 and/or lamp 39.

Figure 7:
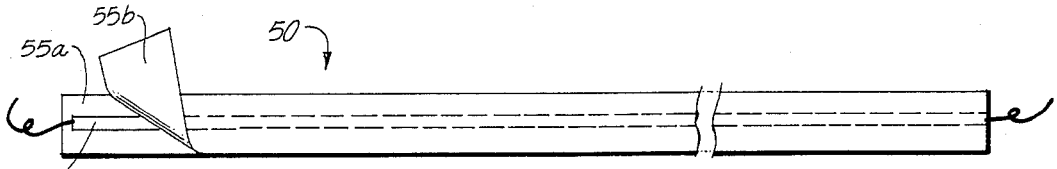
FIG. 7 is a plan view of a second embodiment of the invention, with elements at one end partially separated to better show the constructional details.

Referring now to FIG. 7, another embodiment 50 of the present invention is shown. In this embodiment, the heat-migratable substrate 55 is a long, flexible strip of film. Preferably, two strips, a first layer 55*a* and a second layer 55*b*, are used to fully enclose and protect the flexible conductor 60. Conductor 60 extends substantially lengthwise along strip 55, rather than in the grid pattern of embodiment 10. With the FIG. 7 embodiment, therefore, the strip can be applied to objects, as by adhesive or just by wrapping the strip around them. This is particularly advantageous, for example, for economically protecting containers or other items during shipping, especially where prior protection systems and methods were too expensive to justify the cost.

As may be seen, therefore, the present invention has numerous advantages. It is inexpensive. It is extremely versatile. It can provide a warning long before temperatures which would support combustion are reached. It can respond far more quickly in certain critical applications. For example, when the strip embodiment 50 is secured to drapery (which can burn terribly rapidly once ignited), a warning will be given almost instantly—long before a nearby smoke detector would respond. The particular configuration can be easily adapted to suit the application and geometries at hand. The materials are readily and widely available, with ranges of physical properties which once again allow the invention to be tailored to particular needs. The present invention thus provides an inexpensive, uncomplicated, versatile and reliable fire alarm system and method which lends itself to the widest possible use in giving early warning of a fire hazard, even before tempertures have risen to the point of combustion.

While the methods and forms of apparatus herein described constitute preferred embodiments of this invention, it is to be understood that the invention is not limited to these precise methods and forms of apparatus, and that changes may be made therein without departing from the scope of the invention.

What is claimed is:

1. A fire alarm system comprising:

(a) a pair of flexible sheets of heat-shrinkable plastic film each having a uniform thickness of the order of about 0.030" and having a heat shrinking temperature in the range from about 140°–250° F., (b) a conductor comprising a wire foil having a thickness of the order of about 0.002"–0.004" forming a series circuit sandwiched between said sheets to form a laminate of substantially uniform thickness and configured such that migration of said sheet will interrupt the continuity of said conductor when said sheet is subjected to sufficient heat to cause such heat migration, said sandwich of plastic film sheets and said conductor foil having sufficient physical strength to permit use under conditions of physical stress, (c) circuit continuity monitoring means connected to said conductor to detect interruption thereof, thereby detecting application of a level of heat to said substrate gerat enough to cause such migration, and (d) an alarm connected to said circuit monitoring means generating an alarm signal upon detection of the interruption of the continuity of said conductor.

2. The system of claim 1 in which said metal foil conductor is arranged on said plastic film in an electric grid, the spacing between adjacent elements of said grid being less than about ⅜" to assure detection of a lighted cigarette dropped upon said plastic sheet.

3. The system of claim 1 in which said sheets each comprises a flexible strip of said thermoplastic material, and said conductor extends substantially lengthwise, substantially centrally, along said strips and sandwiched therebetween.

4. A fire alarm system according to claim 1 in which said metal foil conductor is of a low melting solder, and further including low voltage circuit continuity monitoring means connected to said metal foil conductor to detect breakage thereof, thereby detecting application of a level of heat of said substrate great enough to cause such shrinkage, and an alarm connected to said circuit monitoring means for generating an alarm signal upon detection of breakage of said conductor.

5. A heat and fire detector for use in a control or alarm system comprising:

(a) a pair of flexible sheets of heat-shrinkable plastic film each having a uniform thickness of the order of about 0.030" and having a heat shrinking temperature in the range from about 140°–250° F., (b) a conductor comprising a wire foil having a thickness of the order of about 0.002"–0.004" forming a series circuit upon said substrate sandwiched between said sheets to form a laminate of substantially uniform thickness and configured and sized such that migration of said sheet will interrupt the continuity of said conductor when said sheet is subjected to sufficient heat to cause such heat-migration and having end connections adapted to be connected to circuit continuity monitoring means connected to said conductor to detect interruption thereof for indicating application of a level of heat to said substrate great enough to cause such migration and (c) said plastic film sheet and said conductor having sufficient physical strength to permit use under conditions of physical stress.

6. A detector according to claim 5 in which said conductor further comprises a grid of wire foil forming a series circuit upon said substrate, the spacing between adjacent elements of said grid being less than substantially ⅜" to assure detection of a lighted cigarette dropped upon said substrate.

* * * * *